US009109410B2

(12) United States Patent
Swietlik et al.

(10) Patent No.: US 9,109,410 B2
(45) Date of Patent: Aug. 18, 2015

(54) METHOD SYSTEM AND APPARATUS FOR REDUCING SHOCK AND DRILLING HARMONIC VARIATION

(76) Inventors: George Swietlik, Oulton Broad (GB); Stephen John McLoughlin, Apse Heath (GB)

( * ) Notice: Subject to any disclaimer, the term of this patent is extended or adjusted under 35 U.S.C. 154(b) by 951 days.

(21) Appl. No.: 12/733,481

(22) PCT Filed: Sep. 4, 2008

(86) PCT No.: PCT/GB2008/003015
§ 371 (c)(1),
(2), (4) Date: Feb. 23, 2011

(87) PCT Pub. No.: WO2009/030926
PCT Pub. Date: Mar. 12, 2009

(65) Prior Publication Data

US 2011/0198126 A1 Aug. 18, 2011

Related U.S. Application Data

(60) Provisional application No. 60/967,306, filed on Sep. 4, 2007.

(51) Int. Cl.
*E21B 17/07* (2006.01)

(52) U.S. Cl.
CPC ..... *E21B 17/07* (2013.01); *E21B 17/073* (2013.01)

(58) Field of Classification Search
CPC ..... E21B 17/073; E21B 17/07
USPC ..... 175/321, 322, 323; 267/125
See application file for complete search history.

(56) References Cited

U.S. PATENT DOCUMENTS

| | | | | |
|---|---|---|---|---|
| 1,817,067 | A * | 8/1931 | Crowell | 175/232 |
| 3,230,740 | A * | 1/1966 | Fox | 464/18 |
| 3,371,729 | A * | 3/1968 | Carr | 175/293 |
| 4,878,206 | A | 10/1989 | Grosso et al. | |
| 4,901,806 | A | 2/1990 | Forrest | |
| 5,117,926 | A | 6/1992 | Worrall et al. | |
| 5,226,332 | A | 7/1993 | Wassell | |
| 5,321,981 | A | 6/1994 | Macpherson | |
| 5,448,911 | A | 9/1995 | Mason | |
| 5,721,376 | A | 2/1998 | Pavone et al. | |
| 6,021,377 | A | 2/2000 | Dubinsky et al. | |
| 6,065,332 | A | 5/2000 | Dominick | |
| 6,166,654 | A | 12/2000 | Van Den Steen | |
| 6,205,851 | B1 | 3/2001 | Jogi | |
| 6,308,940 | B1 * | 10/2001 | Anderson | 267/125 |
| 6,327,539 | B1 | 12/2001 | Keultjes et al. | |
| 6,732,052 | B2 | 5/2004 | Macdonald et al. | |

(Continued)

FOREIGN PATENT DOCUMENTS

WO WO 2005047640 A2 * 5/2005

OTHER PUBLICATIONS

PCT/GB2008/003015, Written Opinion of ISA.

*Primary Examiner* — Giovanna C Wright
(74) *Attorney, Agent, or Firm* — C. W. Alworth

(57) ABSTRACT

A downhole device comprising a mandrel suitable for connection to a drilling assembly, a housing surrounding the mandrel with the housing being suitable for connection to the alternate end of a drilling assembly and a compensating mechanism configured to adjust an axial force applied to said mandrel by changing the relative position of the mandrel with respect to the housing.

14 Claims, 11 Drawing Sheets

(56) References Cited

U.S. PATENT DOCUMENTS

| | | | | |
|---|---|---|---|---|
| 6,847,304 | B1 | 1/2005 | McLoughlin | |
| 6,920,085 | B2 | 7/2005 | Finke et al. | |
| 6,948,572 | B2 | 9/2005 | Hay et al. | |
| 6,997,271 | B2 | 2/2006 | Nichols et al. | |
| 7,036,612 | B1 | 5/2006 | Raymond et al. | |
| 7,204,324 | B2 | 4/2007 | Gleitman et al. | |
| 7,219,752 | B2 | 5/2007 | Wassell et al. | |
| 7,540,337 | B2 | 6/2009 | McLoughlin et al. | |
| 7,578,360 | B2 * | 8/2009 | Haughom | 175/325.3 |
| 2006/0048941 | A1 * | 3/2006 | Borst et al. | 166/304 |
| 2006/0185905 | A1 | 8/2006 | Haughom | |

* cited by examiner

METHOD SYSTEM AND APPARATUS FOR REDUCING SHOCK AND DRILLING HARMONIC VARIATION

This disclosure claims benefit of priority from U.S. Provisional Application U.S. 60/967,306 filed in the U.S. Patent Office on 4 Sep. 2007.

TECHNICAL FIELD

The present invention relates to oil and gas drilling and more specifically to a method, system and apparatus for reducing shock and drilling harmonic vibration within the rotary drilling assembly.

BACKGROUND

The invention is designed to work cooperatively with commonly utilized components of drilling assemblies. Components commonly in use in the drilling assembly are selected for specific properties. Drill collars, for example, are selected for their ability to convey weight and torque to the bit. Accordingly, they are torsionally rigid, relatively inflexible and are able to be run in compression without detriment. Drill-pipe, by comparison, is less torsionally rigid and has a much lower weight per unit length and is designed to be used in tension. In areas where high levels of drillstring vibration are encountered drillstring component failure is frequently found in the environs of the intersection of drill-collars and drill-pipe.

Acknowledging the problematic nature of the interface between drill collars and drill pipe, heavy wall drill pipe, a hybrid drillstring component, sharing properties of both drill-pipe and drill collars is frequently run as an interface between the drill-collar and drill-pipe elements with the objective of minimizing drillstring failure.

The instant device seeking to improve upon prior art, acts to isolate both drill collar and drill-pipe elements from unwanted harmonics and coupled in the 3 axis of axial, torsional and lateral vibration. These can lead to both torsional and rotational speed variations, phenomena often and collectively referred to in the industry as Slip-Stick.

It is preferably located in the drill-collar element of the drilling assembly and may, additionally, be preferentially equipped with stabilization. Multiple instances of the device may be run in series within a single drilling assembly.

The variables in the drilling process are numerous and while there are some constants, other variables are region specific. The different regions of the Earth where hydrocarbon exploration and development take place yield vastly different geological scenarios resulting in a wide variety of drilling conditions which downhole equipment must survive in order to be functionally and economically beneficial to the drilling process. Geology, formation structures, formation fluid pressures, wellbore tortuosity, wellbore trajectory, drilling fluid type, bit type, bottom-hole-assembly stabilization and casing programs, all play a part in affecting the components of the drilling assembly and the bottom-hole-assembly in particular.

A sequential examination of the drilling process is effective in illustrating the improvements which are proposed by the instant device.

At the commencement of the drilling operation, the drillstring is rotated and lowered into the wellbore until the bit contacts the rock formation. Weight is gradually applied and adjustments to the rotary speed are made until drilling commences.

It is worth noting that the driller, at surface adjusts rotary speed, not rotary torque: thus drilling proceeds with applied constant speed at surface and, not a constant torque. Constant torque would result in lower fluctuations in drill-pipe tortuosity and is at present practically only achieved through utilizing a positive displacement motor (PDM). PDMs represent a form of Moineaux screw assembly, with internal rotor and external stator. Widely used for directional and performance drilling purposes PDMs reduce bit generated stick-slip as the rotor to stator interaction acts as a de-coupler between the torsionally rigid collars and the bit. Recently, high-torque output motors have removed some of this damping effect, until, in terms of stick-slip, in many locations, there is little visible difference between drilling with a positive-displacement-motor and conventional rotary drilling.

A further difficulty is that measured weight on bit is effectively "surface" weight on bit, rather than downhole weight on bit. With the drillstring rotating, effectively nullifying wellbore frictional effects, the surface weight indicator is "zeroed" immediately prior to placing the bit on the bottom of the hole. The difference between the off-bottom suspended weight of the rotating drillstring and the weight of the drillstring during drilling is taken as the effective weight-on-bit.

The cutting action at the rock face depends on the type of bit employed and the parameters which are selected. Interaction with the formation is rendered more complex through geological considerations and the angle of intersection between bit and specific strata of the rock formation. Frictional characteristics between the bit and the rock formation are continually changing: this is especially true for PDC bits which cut the rock by shear-failure mode. Drillstring torque input is also continuously altering as a result of the changing friction and cutting loads within the wellbore. Particularly when drilling with PDC bits this manifests itself as a sinusoidal torque input to the surface motive means.

In the field of rotary drilling the drillstring, obeying Hooke's Law, is perceived to act as a spring. The lower component of the drillstring, often referred to as the Bottom Hole Assembly and consisting of Drill Collars, however, reacts differently to the drillpipe section of the drillstring as it has a very high torsional stiffness.

As a result of having these two major elements incorporated into the drillstring and adding bit generated friction and drill collar torsional resonance the drillstring undergoes harmonic oscillations which, at best, represent inefficiencies in the drilling process and at worst can cause drillstring failure with the added expense and unpredictability of remedial work. These oscillations can cause extremely large variations in rotational speeds at the drill bit whilst the input speed at surface can remain reasonably constant.

Depending on the characteristics of the wellbore, drillpipe, BHA and drill-bit, the torsion may result in perceived reduction in weight on bit, prior to the point of formation failure. This, then, results in additional drillpipe being "released" with the result that the weight on bit oscillates and traps additional torsion in the drillstring.

Adjustment of the at-bit axial feed-rate and compensation for harmonic oscillations in the length of the drillstring is one of the objects of the instant invention.

In summary, it should be stated that the number of sources and interactive characteristics of downhole harmonic vibration have, to date, eluded a generic solution which the instant device seeks to provide.

Background Art

The instant device, therefore, seeks to provide a preventive solution for one of the more destructive elements of the drilling process which occurs in a wide variety of rotary drilling scenarios and with varying degrees of severity. This element, at its most extreme, is often referred to as "stick-slip."

Lesser magnitude events which do not qualify for the label "stick-slip" are more precisely identified as, among others, axial, lateral and torsional harmonics. In the environs of the bit and the bottom-hole-assembly some or all of the following characteristics may be present: drag, stick-slip—which at a maximum may cause the BHA to spin backwards, torque shocks (torsional vibration), drill-collar and bit whirl, drill-pipe buckling, bit-bounce (axial shock loading of the BHA components) and lateral vibration. Warren and Oster in "Improved ROP in Hard and Abrasive Formations, Amoco Drilling Technology DTP 1453, 22 Dec., 1997 comment that once whirl begins it is self-sustaining as the centrifugal force maintains the effect and that stopping rotation is the only effective way to stop whirl. Generally speaking, "stick-slip" represents an extreme of the condition generically referred to as "drilling vibration" or "harmonic vibration."

Any of these conditions results in a sub-optimal drilling process, with the magnitude of the condition being proportional to the reduction in drilling efficiency.

A definition of destructive vibration is required and perhaps the best single definition of stick-slip is given by John Dominick who provides a succinct description of the anomalies of drillstring behaviour in his U.S. patent [U.S. Pat. No. 6,065,332] "METHOD AND APPARATUS FOR SENSING AND DISPLAYING TORSIONAL VIBRATION."

"During drilling operations, a drillstring is subjected to axial, lateral and torsional loads stemming from a variety of sources. In the context of a rotating drill string, torsional loads are imparted to the drill string by the rotary table, which rotates the drill string, and by the interference between the drill string and the wellbore. Axial loads act on the drill string as a result of the successive impacts of the drill bit on the cutting face, and as a result of irregular vertical feed rate of the drill string by the driller. The result of this multitude of forces applied to the drill string is a plurality of vibrations introduced into the drill string. The particular mode of vibration will depend on the type of load applied. For example, variations in the torque applied to the drill string will result in a torsional vibration in the drill string.

At the surface, torsional vibration in the drill string appears as a regular, periodic cycling of the rotary table torque. The torsional oscillations usually occur at a frequency that is close to a fundamental torsional mode of the drill string, which depends primarily on drill pipe length and size and the mass of the bottom hole assembly (BHA). The amplitude of the torsional vibrations depends upon the nature of the frictional torque applied to the drill string downhole, as well as the properties of the rotary table. Torsional vibrations propagating in the drill string are significant in that they are ordinarily accompanied by acceleration and deceleration of the BHA and bit, as well as repeated twisting of the drill pipe section of the drill string."

The magnitude of these torsional characteristics is proportional to the reduction in efficiency in the drilling process: thus, removal or reduction of these destructive elements would, naturally, constitute an improvement to drilling efficiency. The invention proposes removal or reduction of "stick-slip" and, as a result, consequential improvements in drilling performance.

Grosso, (SPE 16,660, September, 1987) concluded; "Downhole measurements of forces and accelerations within the BHA have shown that the vibrations at the bit have large quasi-random components for axial and rotational movements . . . probably due to unevenness of formation strength, random breakage of rock and amplification of these effects by mode coupling . . . ." Grosso also concluded in (U.S. Pat. No. 4,878,206) METHOD AND APPARATUS FOR FILTERING NOISE FROM DATA SIGNALS, that stick-slip action was a combination of torsional and axial movements and that torsional and axial stick-slip measurement should be considered separately. An inventive step which the instant device proposes is to deal with torsional and axial stick-slip simultaneously.

Prior art in the domain of vibration measurement and control is plentiful, yet, to date, there has been little success in creating a panacea for stick-slip or success in diminishing drillstring harmonics and thereby deriving improvements to the drilling process.

The major sources of harmonic vibration have been identified as the rotary drive system above the rotary table, the drillstring, the torsionally rigid element of the BHA component of the drillstring and the bit to formation interaction. Each has an almost continuously varying degree of influence in the total system vibration and adding further complexity, each has an interactive effect on the other. Thus variations in bit generated torque will reflect in drillstring torque which feeds back into the rotary drive system: the system is complex, iterative and chaotically changing.

Prior art in the domain of drillstring vibration damping largely reflects two schools of thought.

The first approach asserts that stick-slip can be diminished through more precise control over the surface drive mechanism. As this represents the variable means of torque input into the drilling system, the premise of this group of industry studies and intellectual property is that by oscillating the drillstring at surface proportionally and synchronously to the observed harmonic frequency of the drilling assembly and in particular the drillstring, that drillstring downhole torque can be controlled and harmonic vibrations and in particular stick-slip reduced to within acceptable limits. Practical applications of this theory have proved effective in some but not all situations.

Worrall, (U.S. Pat. No. 5,117,926) METHOD AND SYSTEM FOR CONTROLLING VIBRATIONS IN BOREHOLE EQUIPMENT provided for control of the energy flow through the borehole equipment by defining "across" and "through" variables "wherein fluctuations in one variable are measured and the energy flow is controlled by adjusting the other variable in response to the measured fluctuations in said one variable."

Van Den Steen (U.S. Pat. No. 6,166,654) DRILLING ASSEMBLY WITH REDUCED STICK-SLIP TENDENCY acknowledging the influence of topdrive and above rotary table harmonics proposes the addition of surface mounted torsional viscous damper sub-systems to the drilling assembly with the aim of introducing a lower rotational resonant frequency into the drilling assembly by negating harmonic influences induced by the rotating equipment located above the rotary table.

Keultjes et al (U.S. Pat. No. 6,327,539) METHOD OF DETERMINING DRILL STRING STIFFNESS proposes the determination of the rotational stiffness of a drill string and in particular determining the moment of inertia of the BHA for optimizing energy within the drilling assembly so as to reduce stick-slip effects.

The second school of thought asserts that downhole measurements and associated downhole mechanisms are the preferred route to controlling stick-slip in the bottom-hole assembly.

Prior Downhole Art

The Prior art in the domain of passive mechanical damping devices for rotary drilling has been deployed for over half a century. Generically such devices are referred to as "shock-subs". Typically these devices have a splined, telescopic shaft axially co-located within a hollow cylindrical housing. When subjected to axial shock these devices perform a controlled telescopic translation along the principle axis of the borehole until the entirety of the shock has been absorbed. Internal damping mechanisms vary, but are predominantly Belleville spring, fluid compression, ring spring or gas charged. These devices have some degree of effectiveness, but are constrained by having their own internal natural frequency, which, at some stage will compound the existing wellbore harmonic. Additionally, shock subs are, largely, incompatible with directional drilling processes, directional wells and also relatively ineffective when dealing with high magnitude harmonic vibrations.

These devices also have inherent natural frequencies of their own which are not field tuneable to provide wider ranges of damping capability. In summary, they individually provide a single solution which attempts to suit the entire range of harmonic vibration conditions. The instant device constitutes an improvement over prior art in that it has no inherent natural frequency, or, alternatively that it has a natural frequency which is adjustable in the distal environment.

Prior downhole art can be further sub-divided into vibration measurement and vibration damping devices.

Early prior art in the field of downhole measurement focussed on the measurement of vibrations in the bottom-hole assembly, with the objective of quantifying accelerational characteristics with the ultimate objective of avoiding critical RPM bands. Downhole sampling and processor speeds in earlier devices precluded analysis across the wider range of harmonics.

Mason, (U.S. Pat. No. 5,448,911) METHOD AND APPARATUS FOR DETECTING IMPENDING STICKING OF A DRILLSTRING utilized a comparative method which identified impeding downhole sticking conditions and compared them to observed surface conditions. The objective of this invention was to identify surface condition parameters which were to be avoided.

Wassell (U.S. Pat. No. 5,226,332) VIBRATION MONITORING SYSTEM FOR DRILLSTRING proposed an alternate configuration for downhole sensors which allowed for enhanced accuracy in measurement of lateral and torsional vibration, once again with the objective of avoiding specific surface condition input parameters.

Pavone (U.S. Pat. No. 5,721,376) METHOD AND SYSTEM FOR PREDICTING THE APPEARANCE OF A DYSFUNCTION DURING DRILLING, focused on the creation of a drilling model constructed from measurements taken from sensors located in the drillstring.

As an alternative to measurement and avoidance of critical vibration across the entire frequency spectrum, prior art corrective procedures have generally focussed on the practical measures of predicting and avoiding critical rotary speeds. SPE Publication, 16675-MS "CASE STUDIES OF BHA VIBRATION FAILURE" by R. F. Mitchell and M. B. Allen, September, 1987 included the following commentary:

"Speeds that might result in destructive lateral vibrations are addressed with equations 9.11 and 9.12 of API RP 7G. A recent study has shown that these equations, even when modified to account for fluid added mass and precessional forces, do not accurately predict critical rotating speeds and do not correspond well with field experience."

By 1990 the aforementioned formulae had been removed from API RP7G, which publication added as a comment:

"Numerous field cases have indicated that previous formulations given in Section 9.1 of API RP 7G, $12^{th}$ Edition (May 1, 1987) did not accurately predict critical rotary speeds and thus have been removed. Presently no generally accepted method exists to accurately predict critical rotary speeds."

Later art in the field of vibration damping through application of downhole assemblies and mechanisms has focussed on intelligent networks and processes which integrate sensor inputs with logic control either encompassed within a downhole device or, alternatively transferred back to surface in order for the operator to make corrective actions.

Accurate measurements of acceleration and vibration are encoded and conveyed back to the surface of the earth using any of a variety of commercially available telemetry methods or, alternatively, recorded in the downhole environment and reserved for post-well analysis. These measurements are then reconstructed to quantify downhole harmonic vibration.

At surface "BHA Modelling" may take place. BHA modelling, largely using finite-element analysis techniques, seeks to avoid specific resonant vibrations which are incompatible with a particular BHA, drill bit and rock formation configuration. However, Jogi (U.S. Pat. No. 6,205,851) METHOD FOR DETERMINING DRILL COLLAR WHIRL IN A BHA AND METHOD FOR DETERMINING BOREHOLE SIZE identified the inherent weaknesses in these modelling efforts, noting that even slight variations in hole enlargement or in drill-collar concentricity caused by bends within the drill-collar, or drill-collar "sag", curvature of the borehole or BHA imbalances reduces pre-well BHA modelling effectiveness as it alters the natural frequency of the BHA. Unfortunately these variations are unquantifiable until the well is in progress.

Research has shown that the main causes of premature bit and BHA damage in any one drilling scenario are, largely, confined to one or two major frequencies with single "sidebands". The abstract of MacPherson (U.S. Pat. No. 5,321,981) "METHODS FOR ANALYSIS OF DRILLSTRING VIBRATION USING TORSIONALLY INDUCED FREQUENCY MODULATION" informs:

"Torsional oscillations of the drillstring will lead to frequency modulation (FM) of the signal from a vibratory source (e.g. the bit). This results in the frequency domain, in sidebands being present around a detected excitation frequency. In accordance with the present invention, it has been discovered that these sidebands may be used in advantageous methods for optimizing drillstring and drilling performance. In a first embodiment of this invention, these sidebands are used to discriminate between downhole and surface vibrational sources."

Dubinsky et al (U.S. Pat. No. 6,021,377) DRILLING SYSTEM UTILIZING DOWNHOLE DYSFUNCTIONS FOR DETERMINING CORRECTIVE ACTIONS AND SIMULATING DRILLING CONDITIONS, provides for a "closed-loop" system where downhole dysfunctions are quantified by sensors and the results telemetered to surface where a surface control unit determines the severity of dysfunction and the operator provides corrective action which is required to alleviate the dysfunction at surface.

MacDonald et al (U.S. Pat. No. 6,732,052) METHOD AND APPARATUS FOR PREDICTION CONTROL IN DRILLING DYNAMICS USING NEURAL NETWORKS proposes:

"a drilling system that utilizes a neural network for predictive control of drilling operations. A downhole processor controls the operation of devices in a bottom hole assembly to effect changes to drilling parameters [and drilling direction] to autonomously optimize the drilling effectiveness. The neural network iteratively updates a prediction model of the drilling operations and provides recommendations for drilling corrections to a drilling operator."

This approach has achieved some recent success; however, its objective is the avoidance of BHA/well specific destructive RPM ranges through operator intervention at surface. Using these methods may reduce harmonic vibration, yet compromise rate of penetration as a result of the selection of sub-optimal drilling RPM ranges. Once destructive harmonics have been identified, they are avoided, rather than negated.

Prior art, therefore indicates that downhole measurements of whatever degree of sophistication are utilized as means for avoidance of detrimental harmonics.

Downhole Vibration Tools

Forrest (U.S. Pat. No. 4,901,806) APPARATUS FOR CONTROLLED ABSORBTION OF AXIAL AND TORSIONAL FORCES IN A WELL STRING proposed the use of a modified positive displacement motor with hydraulic choke means as a method for damping vibrations. The rotor stator interaction is utilized as a torque retractor with additional spring loading. The Forrest device is non instrumented and non-adaptive. The instant device claims improvement in that irrespective of alterations to the downhole environment it is configurable to deliver constant weight and torque via the BHA to the bit face without compromising drilling parameters.

More recently, Gleitman et al (U.S. Pat. No. 7,204,324) ROTATING SYSTEMS ASSOCIATED WITH DRILL PIPE and (U.S. Pat. No. 7,219,747) PROVIDING A LOCAL RESPONSE TO A LOCAL CONDITION IN AN OIL WELL provides for a "controllable element (which) is provided to modulate energy in the drillstring. A controller is coupled to the sensor and to the controllable element. The controller receives a signal from the sensor, the signal indicating the presence of said local condition, processes the signal to determine a local energy modulation in the drill string to modify said local condition, and sends a signal to the controllable element to cause the local determined local energy modulation."

Gleitman further proposes the use of sensors to measure parameters such as strain, pressure, temperature, force, rotation, translation, accelerometers, shock, borehole proximity and calipers. Deployed at various intervals of the drillstring and acting on output from the sensors a series of individual devices are deployed: these devices control axial damping (FIG. 7: Dynamic Bumper Sub, FIG. 8: Dynamic Bumper Sub (Alternate)), torsional damping (FIG. 10: Dynamic Clutch Sub), drillstring vibration, (FIG. 11: Vibrator Sub), and drillstring energy modulation (FIG. 12: Dynamic Bending Sub.) Power for all of these elements is derived from an electrical hardwire run through the internal diameter of the drillstring.

The instant device constitutes improvement over Gleitman as it is functionally autonomous, includes a relatively limited number of inexpensive sensors does not require hard wire back to a surface power source and works semi-autonomously with a lower power budget.

Nichols et al (U.S. Pat. No. 6,997,271) DRILLING STRING TORSIONAL ENERGY CONTROL ASSEMBLY AND METHOD introduce an electro-hydraulically controlled clutch assembly permitting slippage between an upper and a lower component of the drilling assembly. The device uses a plurality of hydraulically controlled pistons to provide friction against hardened cams which are attached to a cam shaft. A plurality of these devices provides for adjustable levels of torque transfer between upper and lower assembly. The instant device represents an improvement over Nichols as it allows for simultaneous torsional and axial compliance, where Nichols provides only torsional compliance.

Haughom, (U.S. Patent Application 2006/0185905) DYNAMIC DAMPER FOR USE IN A DRILL STRING proposes a device which is constructed from "an outer and inner string section and supported concentrically and interconnected through a helical threaded connection, so that relative rotation between the sections caused by torque will give an axial movement that lifts and loosens the drill bit from the bottom of the hole in critical jamming situations." The helical sections are supported on spring means with additional hydraulic damping capability being created by narrow passages between inner and outer members.

The Haughom device offers unilateral axial damping in combination with helical adjustment at a single natural frequency. The instant device considers that bidirectional axial and torsional damping at multiple frequencies is required in order to effectively compensate for drillstring over-feed. Drillstring overfeed causes the over-torsion and severe twisting of the drillstring. The instant device provides for limiting the energy to the drill bit by simultaneously adjusting the torsional load and axial loads independently whilst maintaining the drilling process.

Additionally, the Haughom device functions by lifting the bit from the bottom of the hole, thus disrupting the drilling process; the instant invention allows the bit to remain on the bottom of the wellbore, providing for improvements in drilling efficiency. Furthermore, the instant device also considers that adjustable and adaptive damping is necessary in order to be able to accommodate a broad spectral range of harmonic vibration through an array of fluid transfer chambers and adjustable chokes or valves in the transfer passage between the appropriate chambers.

Raymond et al (U.S. Pat. No. 7,036,612) CONTROLLABLE MAGNETO RHEOLOGICAL FLUID BASED DAMPERS FOR DRILLING sought to overcome the limitations inherent in prior damping mechanisms by proposing a controllable damping apparatus for the downhole reduction of harmonic vibration. This device, which is loosely based on a traditional shock absorber format, has an adjustable element which utilizes magneto rheological fluid ("MRF"). The adjustable element incorporates restrictive valves which control magneto rheological fluid ("MRF") which are housed within a chamber with an orifice separating two sections of the chamber. An electromagnetic coil "employed proximate the orifice" controls the flow of fluid between the two sections.

Magneto Rheological Fluids ("MRF") are fluids which have an initial state and a second state and whose material properties are altered through the presence of a magnetic field. The first, lower viscosity state, is the natural state of the fluid, whereas the second, high-viscosity state is induced through the application of a magnetic field to the fluid. The magnetic field may be induced by application of rare-earth magnets, or, alternatively through the application of an electro-magnetic field. The magnetic field may also be permanent or temporary in nature without detriment to the characteristics of the fluid. Additionally, the field may also be configured to be a bi-state, binary operator, temporary or pulsed, thus making it almost infinitely adjustable across a range of values.

Advantageously, the "activation-time" between fluid states is relatively rapid. The Lord Corporation, manufacturers of fluids with MR properties quote activation times of 0.07 seconds. This corresponds to a frequency of approximately 14.25 Hz, placing it within the upper range of vibrations encountered in harsh drilling conditions.

Magneto Rheological materials encompass materials with both fluid and solid properties. Although MRE ("Magneto Rheological Elastomers") are, from the material property standpoint of containment, preferable to the fluid properties which are encountered with magneto rheological fluids, energy consumption demands which are inherent in MRE deployment make it preferable to utilize MRF. From a comparative perspective, it appears that energizing an MRE takes approximately 2.5 times the power draw of energizing an MRF. Thus, the instant device may incorporate by reference MRE, but preferentially use MRF in its actuation mechanism.

The Raymond mechanism claims means for "providing frictional properties that are alterable while the drillstring is in use; and controlling the frictional properties based upon changing ambient conditions encountered by the bit. The invention preferably dampens longitudinal vibrations and preferably additionally dampens rotational vibrations. Two damping mechanisms in series may be employed." Axial and torsional vibration damping mechanisms are configured separately in the Raymond invention [FIG. 4A/4B.], leading to a device which is substantially longer and more flexible than the one proposed in the instant invention. Further, the torsional element of the Raymond device is constrained to less than 90° of differential rotational damping prior to reaching an end-stop. The constraint is inherent in the format of the hydraulic radial damping mechanism means which utilizes MR fluids which are compressed between an internal rotor and external stator configuration means. [FIG. 3C]: the instant invention is not so constrained and may, dependent on configuration be capable of freedom of motion greater than 90° and in excess of 360° of rotation.

Additionally, the instant invention incorporating torsional damping means within a single device, presents improvements over prior art in that it is shorter, [less than one-third the physical length] less flexible and thus has a more predictable modulus of elasticity for use in bottom-hole-assembly modelling.

The Raymond device has, as its mechanical basis, spring mechanisms, which have natural frequencies and were reported as 32.39 Hz, 26.45 Hz and 12.83 Hz respectively. Despite the use of a "controllable" MR damping element, the experiments which were carried out and reported in Raymond showed that some spring configurations were less beneficial than others:

"The importance of choosing the correct spring stiffness for the shock sub is shown in FIG. 12 for a 1500 lb WOB and 180 RPM in SWG ("Sierra White Granite"). This figure compares the effect of using 32.39, 26.45 and 12.83 Hz shock subs, with comparable damping levels to a rigid system. The 12.83 Hz shock sub performs best."

The conclusion formed in the patent documentation suggests that the 12.83 Hz shock sub may perform best with the bit size and cutter configuration selected in the undertaking the field experiments. However, the inference should not be made, nor does the patent documentation confirm that this particular frequency is particularly significant. Nor is it immediately evident that a sprung system with a lower natural frequency is ultimately more successful across a range of drilling conditions than one with a higher natural frequency.

The Raymond device incorporates a mud powered turbine generator with which to generate electrical power for the downhole device. The turbine generator adds significant additional length to the device.

As will be illustrated, the instant invention benefits from improvements in configuration over the Raymond device.

The Raymond device claims reactive responsiveness to ambient conditions encountered by the bit. The instant device claims adaptive responsiveness as in its third alternative embodiment it integrates imported data pertaining to downhole vibrational constants, surface and downhole information from a variety of sources.

Additional work in this field which focuses on the valve means utilized for the transfer of MR fluid is disclosed in Wassell et al (U.S. Pat. No. 7,219,752) SYSTEM AND METHOD FOR DAMPING VIBRATION IN A DRILLSTRING.

The instant invention claims improvement over Wassell et al in being able to create variable magnetic field intensity with which to influence the fluid properties of magneto rheological fluid elements through relative axial and torsional displacement of its internal components and without having recourse to sophisticated control mechanisms.

Completeness of the Data

The importance to adaptive devices of completeness of data is revealed by, among others, Warren and Oster "Improved ROP in Hard and Abrasive Formations" who, in a detailed discussion on bit wear, make the following observations:

"Whether or not a cutter moves backwards depends on the amplitude of the accelerations, the frequency of the accelerations and the average rotary speed. FIG. 47 shows the amplitude/frequency regions for 60 rpm and 120 rpm where backwards rotation can occur. In general for a typical frequency of 20 Hz, any accelerations over 3.5 G for 60 rpm and 6.5 G for 120 rpm result in reverse rotation. These conditions are often observed on the D(rilling) D(ynamics) S(ub) data.

The implication of this is that without, at a minimum, the amplitude, frequency and average rotary speed of a drilling assembly, active vibration damping whether at the surface of the earth or at a distal location cannot take place. Unfortunately, not all of these inputs can be measured in the downhole environment. Without information pertaining to surface conditions and more specifically to surface RPM, the downhole device may have insufficient information to be able to determine if the distal drilling environment requires adjustment or is within acceptable limits. Thus, the importance of communicating critical information to devices associated with active vibration damping is affirmed. The instant device may claim the benefit of downlinking continuous, or semi-continuous data streams from the surface of the earth to the device and improves upon prior art through the consolidation of both surface and downhole data in the distal location in its approach to the control of harmonic vibration within a single device.

Surface Downlink Capability

A downlink communications protocol is thus required. "Downlinking" refers to the ability to send data from the surface of the earth to a downhole device. Used in conjunction with industry standard "uplink" protocols, these systems are frequently referred to as "closed-loop".

Although "closed-loop" is referred to in several prior art publications, and most recently in particular with regard to providing instructions for 3-dimensional rotary steerable systems ("3D-RSS") its use as a element with which to reduce harmonic vibration have, largely, gone un-remarked.

Hay et al (U.S. Pat. No. 6,948,572) COMMAND METHOD FOR A ROTARY STEERABLE DEVICE, restricts the application of its downlink protocol to usage with a 3D-RSS:

"Claim 1: In a drilling system of the type comprising a rotatable drilling string, a drilling string communication system and a drilling direction control device connected with the drilling string, a method for issuing one or more commands to the drilling direction control device . . . . "

Alternatively, Finke et al (U.S. Pat. No. 6,920,085), "DOWNLINK TELEMETRY SYSTEM" using timed fluctuations in the drilling fluid pressure, provides for instruction via pressure pulses to a downhole assembly. In this case the designated receiving tool is a "Pressure While Drilling" tool.

McLoughlin (U.S. Pat. No. 6,847,304) "APPARATUS AND METHOD FOR TRANSMITTING INFORMATION TO AND COMMUNICATING WITH A DOWNHOLE DEVICE" proposed an intermittent method for communicating between surface and a 3D-RSS device configured about a non-rotating stabilizer format and utilizing variations in the rotary speed of the drilling assembly. Principally, this method allowed for periods of reduced or null rotary speed as significant elements in the communications protocol.

All prior art downlink protocols have in some way compromised the integrity of drilling operations.

The instant device seeks to improve over prior art through utilization of a methodology for communicating information from the surface of the earth to a downhole device on a semi-continuous or continuous basis without compromising the drilling operation. This constitutes an improvement over claims made by prior art. In addition to surface parameters, the downlinked data may incorporate, data derived from measurement-while-drilling "MWD" telemetry and which may further communicate component measurements pertaining to the real-time downhole vibrational state from sensors located in other components of the BHA, to the instant device, via the surface of the earth. The information which is transmitted may be raw, processed or encoded sensor data. At the surface the uplinked information is additionally utilized in order to preferentially modify surface RPM, thus optimizing the environment for operation of the downlink protocol.

A downlink communications protocol application which fulfils these criteria without compromising drilling operations is disclosed in U.S. Pat. No. 7,540,377 to McLoughlin & Variava, ADAPTIVE APPARATUS, SYSTEM, and METHOD FOR COMMUNICATING WITH A DOWNHOLE DEVICE. This proposes a downlink protocol which uses the optimized surface drilling RPM as a baseline for a real-time adjustable communications protocol. Advantageously, the system is capable of adaptive recalibration to accommodate alterations to the baseline RPM, without compromising drilling performance. At surface minor alterations to the frequency of the baseline drilling RPM are made in accordance with pre-determined timing intervals with the objective of conveying information to a device or multiple devices located at the distal end of the drilling assembly. The downhole device is equipped with instrumentation means such that rotation can be determined in order to be able to identify alterations to rotational speed in the distal environment.

Thus a significant improvement which the instant device claims over prior art is the ability to incorporate surface and downhole data within devices located within the distal environment through closing of the communications loop between the surface of the earth and the instant downhole device. This is accomplished without detriment to the drilling process.

Additionally, the inventors believe that the partial successes of prior art and the body of information accumulated to date indicate that it is insufficient to focus on a single source of harmonic drilling problems to resolve a solution, and that an integrated closed loop and in addition, adaptive approach may be required in some circumstances.

This integrated and adaptive approach allows for continuous adjustment of the damping capabilities and characteristics of the instant device in response to changes in drilling conditions. The ability, conferred by downlink protocol, of an instrumented version of the instant device to comprehend alterations to proximal drilling harmonics is perceived as an improvement over prior art. The characteristics may be derived from a variety of sensors and instruments located either within the drilling assembly or at the surface of the earth.

Thus the versatility of the damping system and method increases, creating the ability to adapt to changing drilling conditions in real time without compromising the efficiency and effectiveness of the drilling process.

SUMMARY OF THE INVENTION

In a first aspect, the present invention provides an adaptive, combined axial and torsional compensation system, method and apparatus for active vibration damping In a second aspect, the present invention provides an adaptive system, method and apparatus for substantially diminishing drill collar induced vibration comprising a drill collar sub of equivalent or near equivalent diameter with the drill collars employed in the proximal BHA. The device constitutes an improvement over prior art in that it claims the benefit of providing a constant force on bit cutter loading. Additionally, it claims the benefit of being able to adjust for drillstring over-feeding by the driller and compensation for variations in drillstring length which result from alterations to torque loads initiating slip-stick, which feature is associated with rotary drilling. It has several configurations of varying complexity and adaptiveness. More complex configurations may be instrumented and may preferentially have communications with the surface of the earth. Operationally, at its most simple, adjustment is made by altering the position in which it is placed in the drilling assembly. This would be one method of calibrating the tool for a particular application. The device, although functionally autonomous, may preferentially work in collaboration with a surface downlink protocol which is responsible for transferring information pertaining to drilling parameters and conditions from the surface of the earth.

In a further embodiment, the invention claims a natural frequency which is alterable in the downhole location which advantageously provides for compliance across a wide range of drilling scenarios. Yet a further advantage is that the device is inherently efficient, with an inherently low internal power requirement.

In a further embodiment, the device and downlink protocol may also preferentially work in conjunction with a near-bit harmonic isolation sub which may be deployed in the near-bit stabilizer position. The harmonic isolation sub is the subject of a Co-ending US Provisional Patent Application entitled "ADAPTIVE SYSTEM, METHOD AND APPARATUS for ACTIVE VIBRATION DAMPING AND CONTROL OF DOWNHOLE SYSTEMS" and filed on Sep. 4, 2007 as Ser. No. 60/967,307 and published as WO 2009/030925 A2/A3 under the title "A Downhole Assembly."

Whereas the object of the harmonic isolation sub is to isolate the drilling assembly from bit generated harmonics through minimizing peak loading of bit cutters, the objective of the instant device is to isolate the drilling assembly from cyclic torsional variations which are created by fluctuations in bit load. Additionally, the instant device compensates for drill-collar induced harmonics.

Collectively, the downlink protocol, harmonic isolation sub and torsion sub constitute a complete inter-active and adaptive system for the reduction of drilling harmonic vibrations across a wide range of drilling parameters and drilling conditions.

In an embodiment, the device constitutes an improvement over prior art in that it provides means for translating the relationship between axial compliance and torsional load variations through means of a device which is preferentially located within the lower BHA and typically, proximate the instrumented components of the drilling assembly. In summary, the device comprises a mandrel circumferentially encompassed by a tubular housing. Located in the annulus between the outer diameter of the mandrel and the internal diameter of the tubular housing is a sleeve element which is equipped with means to convert axial vibration into rotational motion. Additionally, the device claims the benefit of having a primary natural frequency of damping which is derived from a pre-loaded state and which is alterable in the downhole location only when the pre-loaded state is exceeded. A secondary, adjustable and adaptive damping means preferentially takes advantage of the relative rotational position of the mandrel, housing and sleeve elements by altering the fluid properties of magneto-rheological fluid enclosed therein. Alterations to the apparent plastic viscosity are proportional to the exposure of the MR fluid to magnetic fields. The exposure may either be by rare-earth magnets or electro-magnetic coil sub-assemblies. Utilizing, for preference, the rare-earth magnet configuration, advantageously, provides for low power consumption, great energy efficiency and adaptive compliance across the entire range of drilling vibrations.

In an embodiment, the device is instrumented and equipped with sensors which measure appropriate parameters pertaining to the downhole environment. The sensors also equip the instant device, allowing for downlink protocol capability and integrated and adaptive damping. A downlink protocol which may be preferentially utilized with the instant device is the subject of U.S. Pat. No. 7,540,377.

The instant device and downlink protocol may also preferentially work in conjunction with an adaptive system, method and apparatus in the form of a harmonic isolation sub which is preferably located in the drilling assembly immediately proximate the bit. The objective of the harmonic isolation sub is to remove bit generated vibration from the lower BHA by providing active and adaptive damping. The harmonic isolation sub is the subject of a Co-pending US Provisional Patent Application entitled "Adaptive System, Method and Apparatus for Active Vibration Damping and Control of Downhole Systems and filed on Sep. 4, 2007 as Ser. No. 60/967,307 and published as WO 2009/030925 A2/A3 under the title "A Downhole Assembly."

In a further aspect, the present invention provides a system incorporating an active downhole device providing damping across multiple harmonic frequencies and amplitudes said means providing integrated axial and torsional fluid displacement means in response to dynamic drillstring torque and compressive conditional loading.

The above method and apparatus may provide a device which can decouple and adjust for axial and torsional compliance simultaneously in response to varying dynamic forces generated by the drilling process.

In an embodiment, in an initial configuration a sleeve element is axially encapsulated between pre-loaded compression spring means within a housing, which compression spring means being overcome results in relative helical rotation of sleeve element which also comprises of axial translation with respect to mandrel and housing, thereby providing primary axial and torsional compliance means at a specific harmonic frequency. The sleeve rotational translation may have in excess of 90° freedom of motion.

In a further aspect, the present invention provides a system incorporating an active downhole device adaptively providing non-oscillatory damping means across multiple harmonic frequencies and amplitudes said means providing integrated axial and torsional fluid displacement means in response to dynamic drillstring torque and compressive conditional loading Sensors and instrumentation may confer iterative and intelligent damping system capabilities. The sensors and instrumentation may further allow for inclusion of external sensor measurement input via downlink communications.

In an embodiment, hydraulic damping by means of alteration of the particular properties of magneto-rheological fluid provides secondary axial and torsional compliance means at a second specific harmonic frequency. The hydraulic damping may be achieved by influencing the transfer of fluid between a first and a second reservoir containing hydraulic fluid. The activation means may be rare-earth magnet or an electro-magnetic coil assembly.

Finally, the device may be equipped with stabilized means.

BRIEF DESCRIPTION OF THE DRAWINGS

The present invention will now be described with reference to the following non-limiting embodiments in which.

MODES FOR CARRYING OUT THE INVENTION

Position within the BHA

Figure 1:
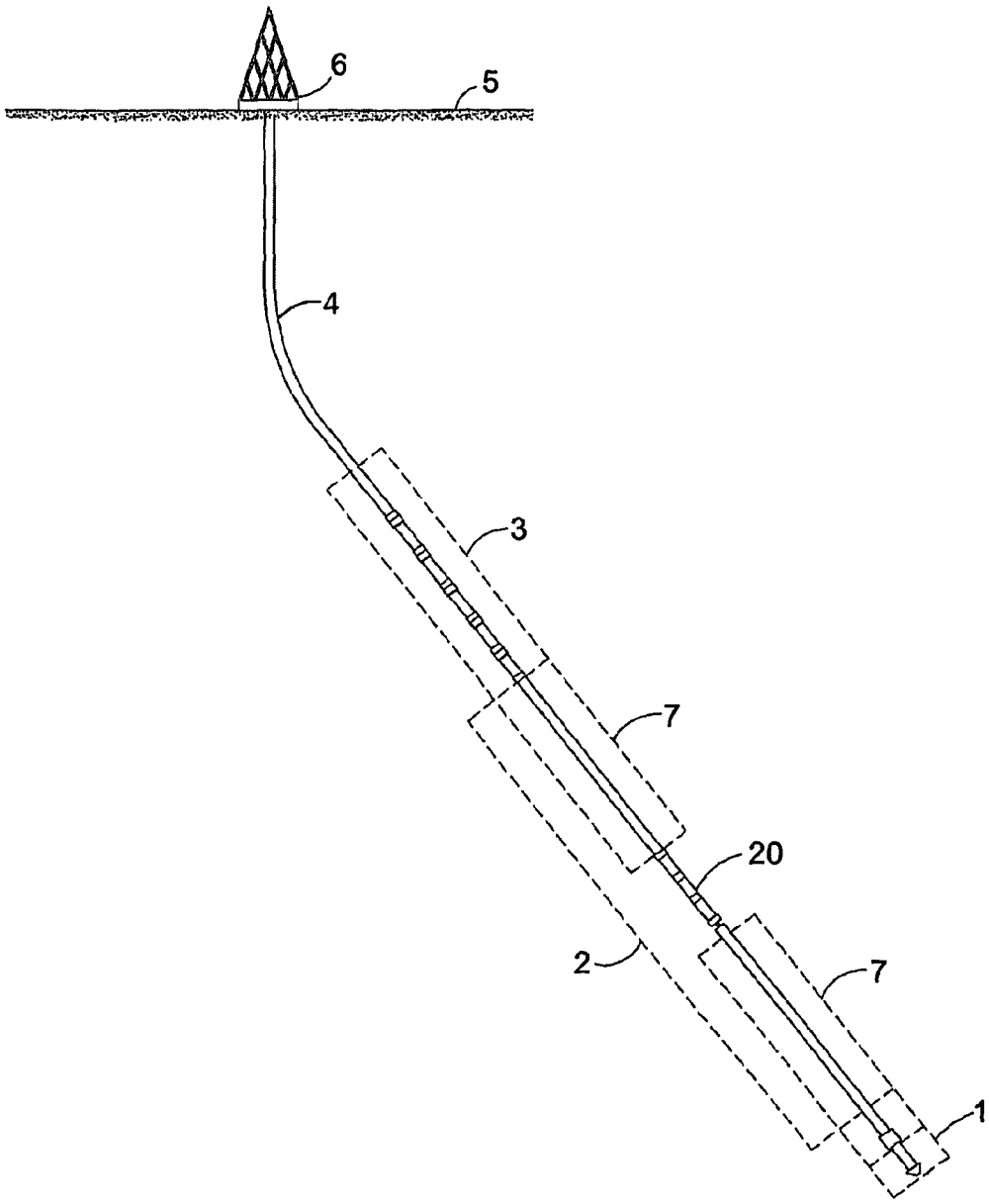
FIG. 1: is a part diagrammatic, part schematic view of the instant device located within a conventional drilling assembly.

The device is designed to be an integral part of a standard drilling assembly. FIG. 1 illustrates the basic schematic of a drilling assembly incorporating the device. A bit [1] is located at the distal end of the drilling assembly or BHA [2]. Above the BHA [2] are heavy weight drill pipe [3] or normal drill-pipe [4] which are attached at the surface of the earth [5] to a motive means [6]. The motive means provides for the application of torque to the drill bit. Weight is provided by means of drill collars [7] preferentially located at the distal end of the drilling assembly. The instant device is typically located within the drill-collar elements [7], but may be located elsewhere within the drilling assembly, subject to the specific requirements of a well structure and drilling conditions and may be stabilized or "slick" as required. Figures incorporated herein show a "slick" torsion sub. Stabilization means are well understood within the industry and may take any of many forms such as "welded blade", "integral blade" or, preferentially "ring-bladed".

In an alternate deployment designed for locations where harmonic vibration reaches extreme levels, a plurality of the instant device may be employed in series or spaced at intervals within the drilling assembly. Embodiments of the instant device will now be introduced.

PRIMARY EMBODIMENT OF THE INVENTION

Figure 2:
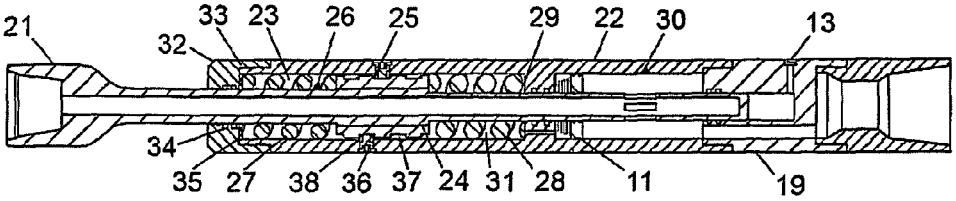
FIG. 2: is a longitudinal cross-sectional view of the device.
Figure 3:
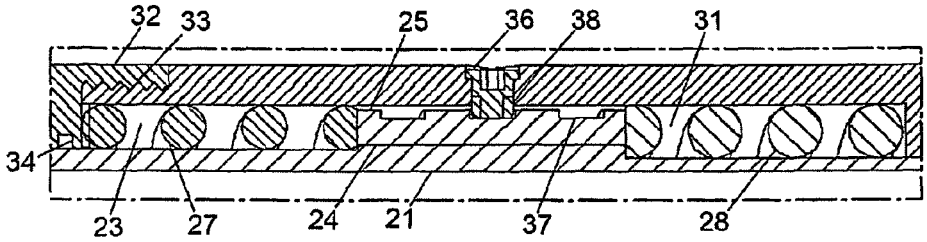
FIG. 3: is an enlarged longitudinal cross sectional view of the active sleeve element of the instant invention in situ within the housing.

In a first embodiment of the invention, as illustrated in FIGS. 2 and 3, a mandrel [21] is co-located within a tubular housing [22] and which is also constrained to limit its axial travel in either direction relative to the housing [22]. The mandrel and housing are configured in such a way as to contain between their surfaces, an annular chamber [23]. The mandrel element [21], preferentially located at the distal end of the device is splined [24] on its outer circumferential surface [26] to enable transfer of torque between housing [22] and mandrel [21] via a sleeve [25] or in the alternative arrangement a sleeve [50] as described in FIGS. 6 to 8, FIG. 10 and FIGS. 12 to 13, inclusive. The mandrel [21] is, conventionally, tubular in cross section to allow the passage of drilling fluids to distal elements of the drilling assembly and the bit. The drilling fluid flow passage in the bore of the drillstring passes into upper portion of the tool [19] and through the housing flow bypass ports [not numbered] and enters the bore of the mandrel shaft [21] via the mandrel shaft flow bypass ports. In the alternate arrangement shown in FIG. 9 this feature is not required.

A sleeve element [25], is contained in the annular chamber [23], located between mandrel and second housings.

The housing [22], axially located within the bottom-hole assembly, "BHA" [2] of the drilling assembly, at a proximal location in relation to the mandrel [21] and radially co-located outside the mandrel [21] allows, within the constraints provided for by distal compression springs [27] and proximal compression springs [28] for axial motion between the mandrel [21] and housing [22] elements. In an alternative arrangement the distal compression spring can be omitted from the design to change the performance of the tool.

An internal stop-collar [29] provides the upper limit of the proximal or upper chamber [31] and in collaboration with proximal compression spring [28] provides means for limiting the upward travel of the sleeve [25] relative to the mandrel [21]. The stop collar [29] separates the two lower chamber elements; an upper, or proximal, chamber [31] and a lower or distal, chamber [23] to the mid section of the tool where the drilling fluid flow is transferred to the inside of the mandrel via the mandrel shaft flow by-pass ports. Thus compartmentalized, the lower part of the housing element [22] provides means for efficient compression of the spring elements [27], [28], through incorporation of a distal cap assembly [32], which is preferentially attached with a threaded means [33] to the housing assembly [22]. Compression of the spring sub assemblies [27], [28], is thus accomplished between the internally mounted stop collar [29] and the distal cap sub assembly [32].

As will be apparent to those skilled in the art, the thread characteristics and profile [33] should be sufficient to adequately constrain the spring force [27], [28]. Additionally, the thread length should be selected in order to provide optimal means for assembly, such that during assembly several threads are engaged prior to encountering significant pressure from the internal spring assemblies. The threaded cap assembly may preferentially be equipped with sealing means on both the threaded section [33] and also on the frictional surface [34] between mandrel and housing. Shims [35] may be preferentially employed in order to simplify adjustment of the spring force within the proximal chamber [23].

The spring elements [27], [28], are pre-loaded with compression which is proportional to the anticipated weight on bit and the required resistance to the maximum torque generated by the bit. Practically, this determines the relative position of the instant device [20] within the distal element or "BHA" [2] of the drilling assembly. It is envisaged that the invention will typically be deployed in the drilling assembly, between the drill bit [1] and the drillpipe [4]. An economic advantage is conferred through adjustment of the position of the device within the drilling assembly, relative to the drillbit [1], rather than through field alteration of the internal characteristics of the device, thus avoiding expensive field operator intervention. An additional benefit is gained when the device is installed at any location which is not proximate the BHA [2] as the device does not interfere with the more sophisticated measurement and directional elements of the bottom hole assembly.

The housing [22], is equipped with a plurality of cylindrically formed keys [36], which are inserted through the interior wall [30] of the lower annular chamber [23], locating and engaging within the helical groove [37] preferentially formed within the outer diameter of the sleeve element [25]. The keys [36] may be threaded into the wall, or secured by other means known to those skilled in the art. The metallurgy and construction of the keys [36] is substantive and is such that the transfer of rotary drive and the entire loading of the BHA elements [2] located distally with respect to the instant device may be placed upon them. Bearings [38] may be employed to reduce friction between key and sleeve sub-elements. Alternate forms of keys may be employed without departing from the spirit of the invention.

The axial travel of the sleeve [25] within the instant device [20] is generated, responsive to increased opposing cutting torque transfer from the face of the bit [1]. This adverse bit functionality manifests itself, in the first instance, at surface, as a reduction in observed weight on bit due to shortening of the drillstring through trapped torque. Reactively, whether through human or mechanical intervention, in the distal environment this reveals itself as a compensatory excessive transfer of weight to the bit face. It will be evident to those skilled in the art that this series of events is cyclical and repeated. Variations in magnitude are well specific.

Referring to FIG. 2; the upper annular chamber [31] which is located proximally in relation to the stop collar [29] houses a compensation piston assembly [11] which is designed to be in fluid communication with the chamber below the stop collar [29] whilst adjusting for the inside drillpipe pressure. In an alternative arrangement the fluid pressures in both lower [23] and upper [31] chambers maybe compensated to the annular pressure. To neutralize the effects of pump open forces which act on the mandrel [21] as a product of drilling fluid circulation through the drill bit [1]. The upper sub assembly of the instant device [19] contains means for negating the effect of pump open forces via the annular venting chamber and annular venting port and filter [13]. By this method a hydraulic balancing force is achieved at each end of the mandrel by exposing each end to the same differential pressure between internal and annular pressures created by the pressure drop across the bit.

Figure 4:
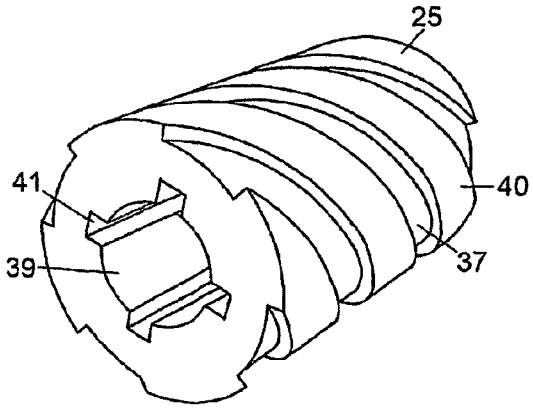
FIG. 4: is a three-dimensional view of the sleeve element of the device.

Referring to FIGS. 3 and 4: Simply expressed, the tubular sleeve [25] is equipped with two circumferential surfaces. The internal circumferential surface [39], is configured with an axial groove or a plurality of axial splined grooves [41] which may substantially conform to the principal axis of the borehole and which cooperatively engages with the splines [24] incorporated into the outer circumferential surface of the mandrel [26] {annotated in FIG. 2}.

The external surface of the sleeve [40] is configured with a radial helical groove [37] or a plurality of radial helical grooves [37] which in engagement with a key or a plurality of cylindrical keys, [36] allows for torque to be transferred from the mandrel [21] to the housing [22] whilst still enabling relative axial motion between them enabling the sleeve to [25] translate rotationally relative to the housing [22]. This component represents the major innovation in this design.

The helical groove(s) [37] may be of differing forms, and with variable depth, pitch and circumferential length, representing a constant helical form. Alternatively, the sleeve helical form can be of variable rate. Different helical form means may be employed, depending on the anticipated drilling environment, drillstring element outer diameter constraints, anticipated torque load and anticipated axial travel in order to optimize the format of the instant device to the environment. It is envisaged that the helical form will enable in excess of 360° of relative motion between mandrel and housing within a single element which constitutes an improvement over prior art damping mechanisms.

Reversing the positions of the helical [37] and axial grooves [41], such that the helical groove [37] is machined into the internal diameter [39] of the sleeve element [25] and the axial grooves [41] are machined onto the outer diameter [40] of the sleeve element [25] or other modifications to the form of the groove are equally within the scope of the instant device, but may be less favourable from a manufacturing perspective.

It will be apparent to those skilled in the art that bearings may be employed to ensure that friction is minimized when relative motion between mandrel [21] and housing [22] occurs. Any appropriate selection of bearing form, quantity and type may be made without departing from the spirit of the invention.

Figure 5:
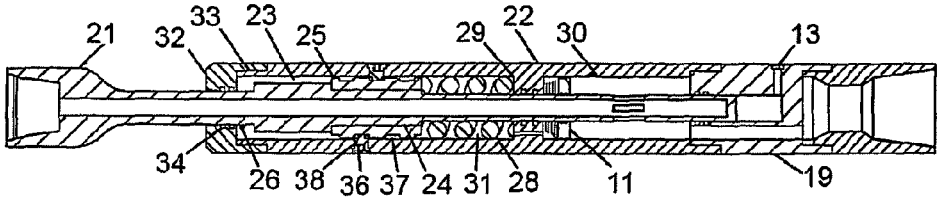
FIG. 5: is a longitudinal cross sectional view of a simplified construction of the device.

Alternative configurations will now be introduced which may result in simpler construction, without departing from the spirit of the invention. For example, as illustrated in FIG. 5, the distal spring assembly [27] proximate the bit [1], may be omitted as the principal direction of correction within the instant device always results in axial shortening of the assembly.

Figure 6:
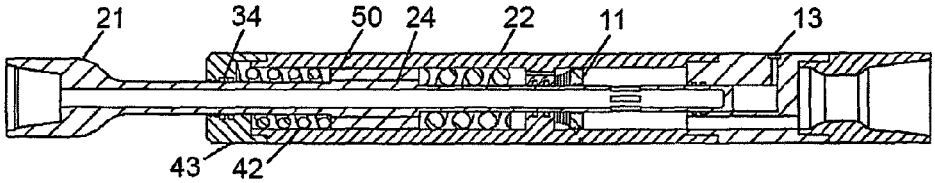
FIG. 6: is a longitudinal cross-sectional view of a device incorporating a simplified sleeve design.
Figure 7:
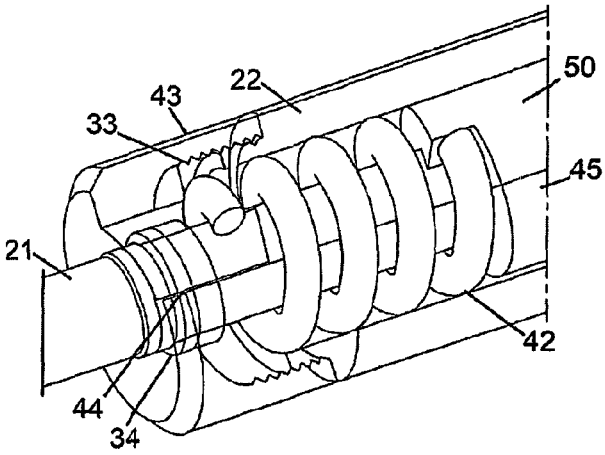
FIG. 7: is a three-dimensional view of the distal component of the simplified sleeve component.

FIGS. 6 and 7 illustrate detail of an alternative design which may be most effectively utilized in smaller diameter hole designs where inserting keys through the housing wall may result in structural weakness. In this design, the functionality of the external keys [36] is replaced by an encapsulated compression spring [42] distally located in relation to the modified sleeve assembly [50]. The internal surface of the sleeve [39], with its axial keyways [41], remains unaltered. However, the external surface of the sleeve [40] is not configured with helical grooves [37]. As with prior descriptions, linear travel within the tool is proportional to opposing torque; however, in this design the linear travel is achieved through the twisting of an encapsulated compression spring [42]. If a compression spring is unwound, its effective length increases due to an effective increase in the spring rate. Inversely, if the spring is twisted in the opposite way its effective length decreases. FIG. 7 illustrates a configuration of the device where the lower drive spring [42] is utilized to confer relative torsional motion between mandrel [21] and housing [22]. The spring is torsionally anchored between a supporting surface [44] on the distal cap assembly [43], and a comparable supporting surface [45] located at the distal end of the sleeve element [50], thus facilitating torque transferral between mandrel [21] and sleeve [22], while still allowing relative linear motion there between. Operationally, an increase in opposing drilling torque will act to unwind the spring, raising the drive sleeve [25] and effectively reducing the weight on bit.

Figure 8A:
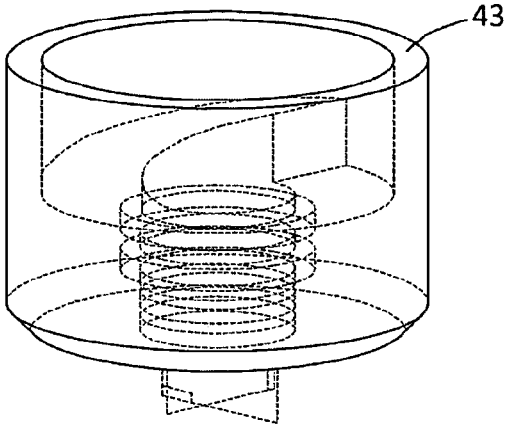
FIG. 8A: is a three dimensional transparent cutaway drawing of the end cap for use with simplified sleeve component.
Figure 8B:
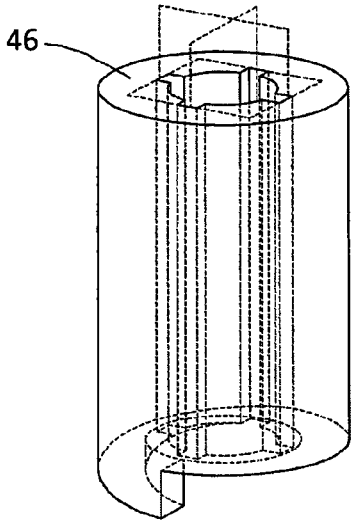
FIG. 8B: is a simplified three dimensional transparent cutaway drawing of the simplified sleeve component.
Figure 8C:
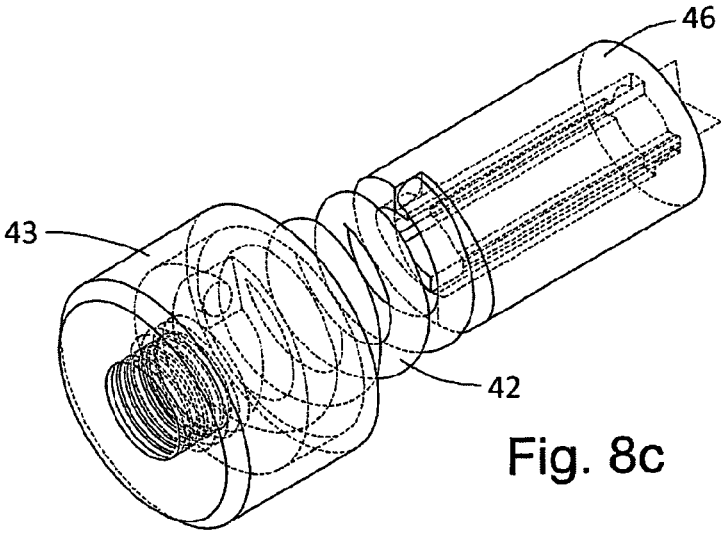
FIG. 8C: is a simplified three dimensional transparent cutaway drawing of the coupled driving assembly.

FIGS. 8A and 8*b* reveal the modified structures of distal end cap [43] and drive sleeve [46] and FIG. 8*c* reveals the coupled driving assembly without sleeve or mandrel elements being illustrated.

Figure 9:
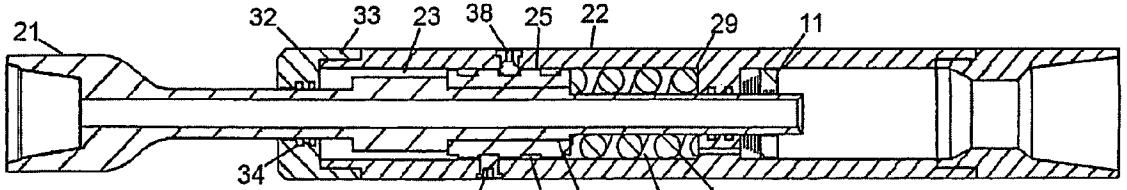
FIG. 9: is a simplified longitudinal cross sectional view of the device constructed without pump-out force balancing sub-assemblies.
Figure 10A:
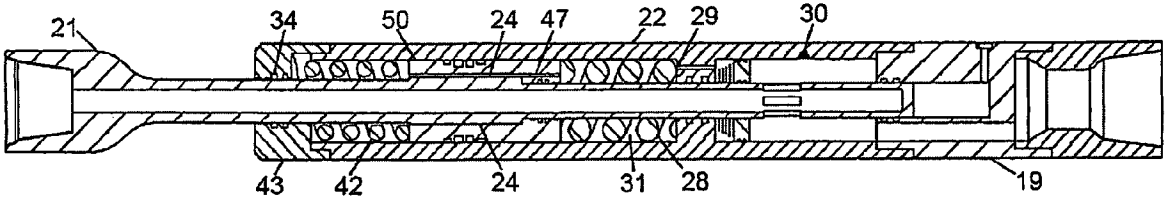
FIG. 10*a*: is a longitudinal cross section of the device incorporating a sleeve sub-assembly depicted in FIG. 6 and modified for use with magneto rheological fluids.
Figure 10B:
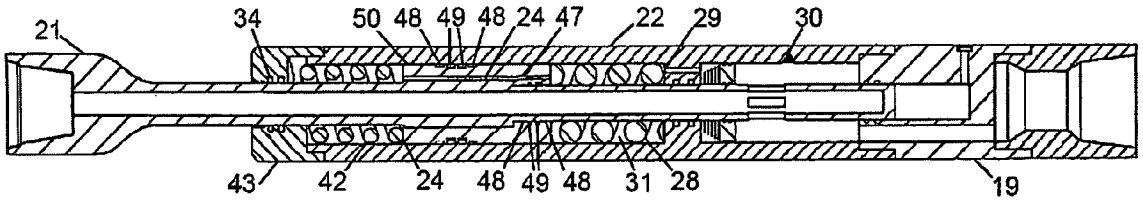
FIG. 10*b*: is a longitudinal cross section of the device incorporating a sleeve sub-assembly depicted in FIG. 6 and modified for use with magneto rheological fluids, highlighting seal-sub assemblies.
Figure 10C:
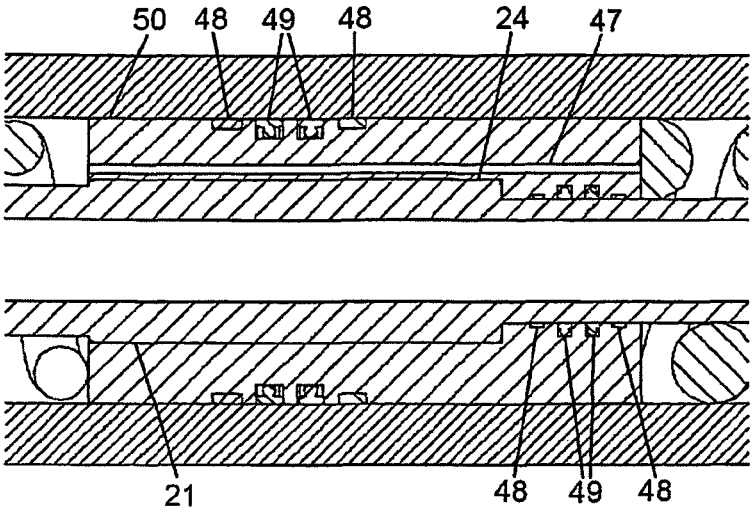
FIG. 10*c*: is an enlarged partial longitudinal cross section of the modified element of the sleeve sub assembly depicted in FIG. 10*a* focussing on seal assemblies and fluid channels.
Figure 10D:
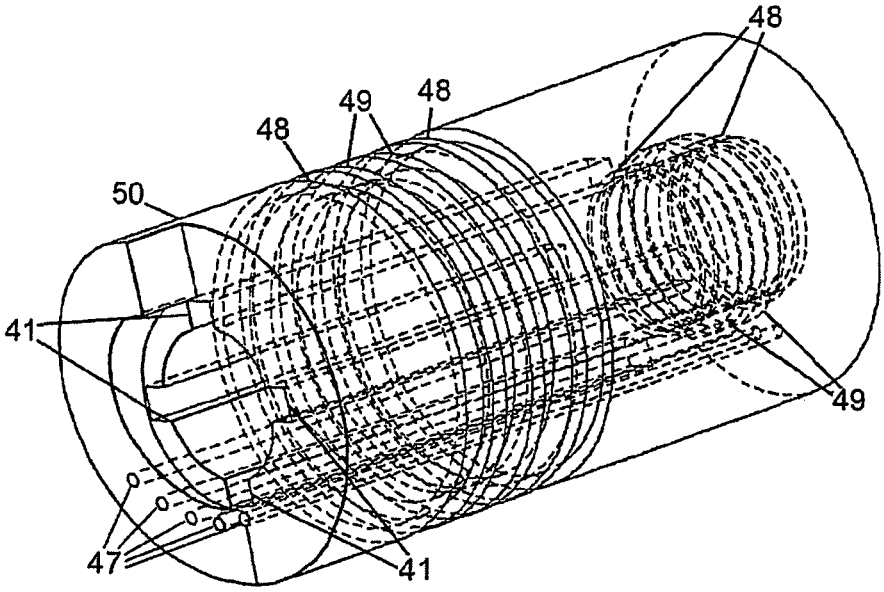
FIG. 10*d*: is a three-dimensional wire-frame representation of the modified sleeve sub-assembly depicted in FIGS. 10*a* and 10*b*.
Figure 10E:
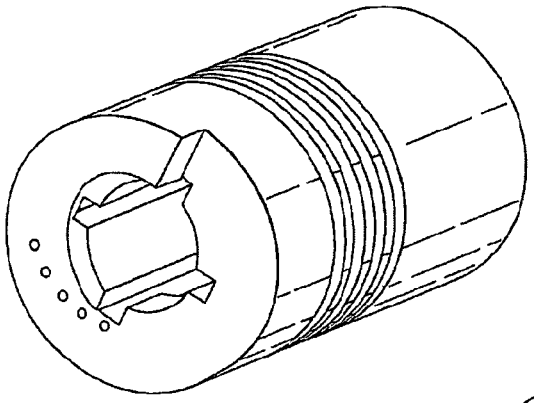
FIG. 10*e*: is a three-dimensional rendering of the distal view of the modified sleeve sub-assembly depicted in FIGS. 10*a* to 10*c*.
Figure 10F:
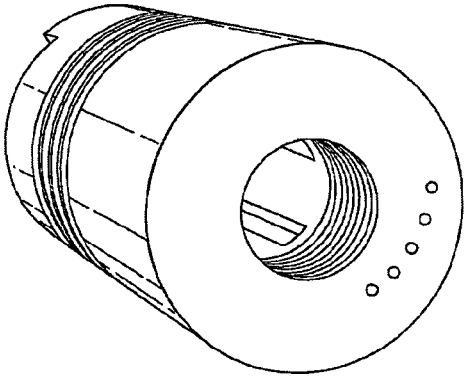
FIG. 10*f*: is a three dimensional rendering of the proximal view of the modified sleeve sub assembly depicted in FIGS. 10*a* to 10*d*.

FIG. 9 shows a simplified version of the tool wherein the proximal section of the tool [19] which is responsible for balancing the pump opening force has been removed. Although this represents a simplification to the mechanical construction of the device, there are operational issues which require resolution in order for this design to be effective.

SECONDARY EMBODIMENT OF THE INVENTION

FIGS. 10*a* through 10*e* illustrate the modified sleeve sub assembly [50] of FIGS. 6 and 7, incorporating internal and external sealing means [48], [49] and introducing sleeve fluid bypass ports [47].

As previously discussed, the instant device proposes the use of magneto-rheological fluids, "MR Fluids" to provide variable, incremental, hydraulic damping means which have a natural frequency which is unrelated to the damping provided by compression spring means [27], [28] or, in the encapsulated spring sub assembly, alternatively [27], [42].

In order for the fluid to pass through the sleeve bypass ports [47] which are bored through the MR fluid sleeve sub-assembly [50], sealing means must be employed on the outer diameter and the inner diameter of the sleeve As the device is subject to both rotational and reciprocal motion both "wiper" seals with rotational capability [48] and energized seal sub-assemblies [49] will be required. The sleeve fluid bypass ports [47] thus allow for hydraulic damping capability within the instant device. Although the encapsulated distal compression spring [42] and the proximal compression spring [28] confer significant damping capability, their utility is constrained by the inherent natural frequency. Through the addition of integrated axial and torsional fluid displacement means, additional damping with variable frequency is attained which ability is claimed as an inventive step of the instant device.

The damping which is conferred is a function of the fluid transfer rate between proximal chamber [31] and distal chamber [23]. This in turn is a function of the fluid properties and rheology which affects fluid transfer capability. Preference is given for the use of MR Fluids whose apparent fluid viscosity may be altered through imposition of a magnetic field; however, non-MR fluid hydraulic damping means may also be employed without departing from the spirit of the invention.

Figure 11:
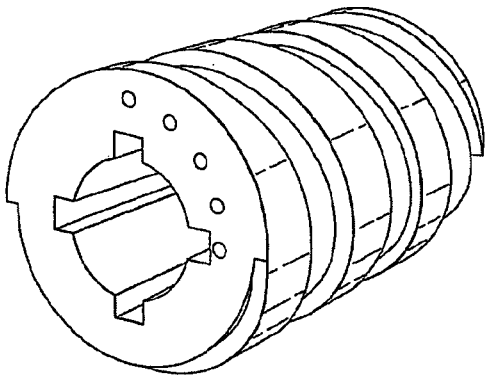
FIG. 11: is a three-dimensional view of the sleeve sub assembly depicted in FIGS. 2 to 5 modified for usage with magneto rheological fluid bypass channels.

FIG. 11 illustrates a sleeve sub assembly [25] complete with external helical groove means [37] configured to incorporate sleeve fluid bypass ports [47]. A feature of the positioning of these ports within the sleeve device is their progressive helical departure away from the centre of the mandrel towards the outer diameter of the device. This helical configuration preferentially allows for incremental magnetic fields to be applied to MR Fluids which pass through the bypass ports [47]. The magnetic field is proportional to the degree of axial and rotational travel of the sleeve sub-assembly [25] in relation to the housing [22] and the mandrel [21]. This feature is applicable to either the helically grooved sleeve sub-assembly [25] or the 'slick', modified sleeve sub-assembly [50].

Figure 12A:
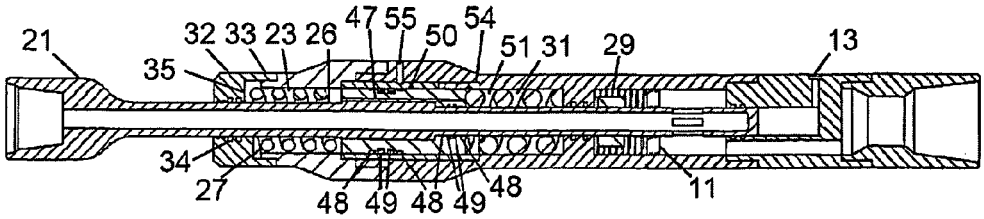
FIG. 12*a*: is a longitudinal cross sectional illustration of the essential sleeve element of FIG. 6, modified to allow for the positioning of rare-earth magnets for energizing the magneto rheological fluid so as to achieve a variable and progressive damping effect.
Figure 12B:
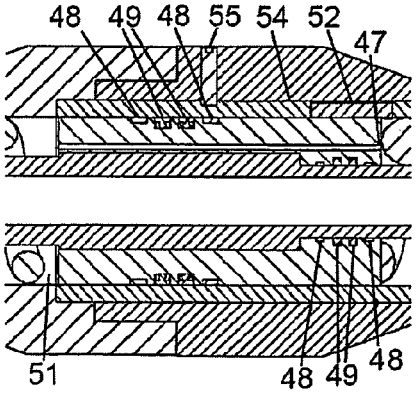
FIG. 12*b*: is an enlarged cross section of the magnet carrying sleeve sub-assembly from FIG. 12*a*, depicting rare-earth magnet retaining sleeve and locking mechanisms.
Figure 12C:
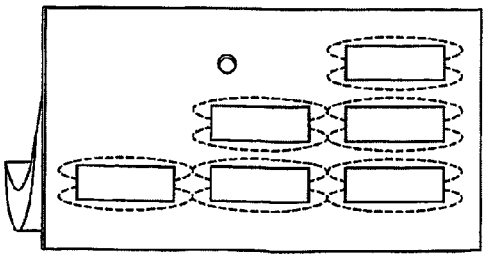
FIG. 12*c*: is a cross sectional depiction of one configuration of progressive and incremental magnetic fields associated with the modified sleeve element of FIG. 6.

FIG. 12*a* through 12*c* illustrates a configuration of the instant device which is equipped with rare-earth magnet means for purposes of altering the apparent viscosity of the MR Fluid [51]. For ease of manufacture, the magnets are installed in a separate sleeve [54] which is keyed [55] to the housing [22]. As with previously described Figures which incorporate fluid channel means within the sleeve sub assembly [25] [50], sealing means [48], [49] are employed to ensure that fluid passes preferentially through the shaft flow passage ports [47].

This configuration, with the magnet sleeve means [54] being keyed [55] to the housing [22] is advantageous because the degree of magnetic influence exerted by the rare earth magnets [52] is proportional to the relative distance travelled between the MR modified sleeve [50] and the housing [22]. Thus, as axial and radial travel is inter-related, the magnetic field can be designed to provide incremental damping. A further advantageous feature associated with the combined axial and radial motion of the device is the elimination of the risk of hydraulic locking the MR element which might ensue if the relative motion was purely reciprocating.

THIRD EMBODIMENT OF THE DEVICE

Figure 13A:
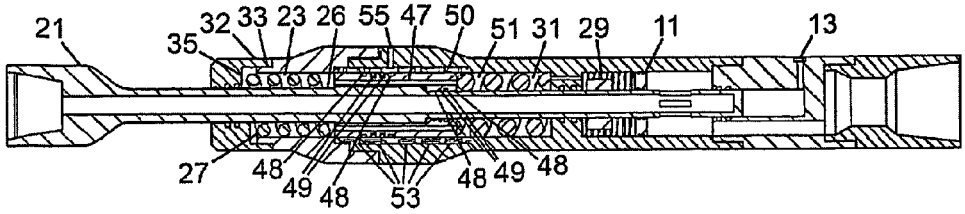
FIG. 13*a*: is a longitudinal cross-sectional schematic indicating the instant device in its entirety, based upon the sleeve design of FIG. 6, equipped with electro-magnetic coils for energizing the magneto rheological fluid so as to achieve a variable and progressive damping effect.
Figure 13B:
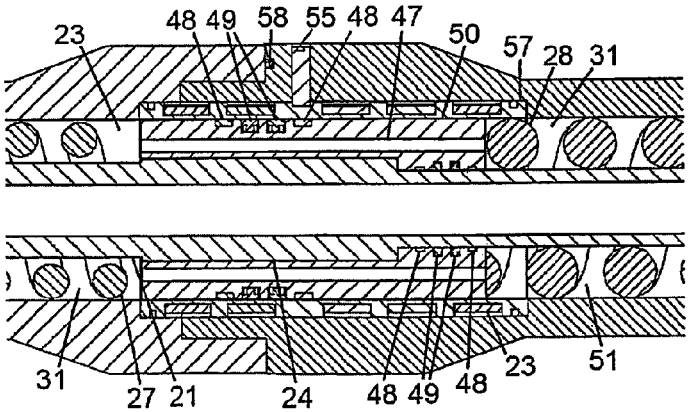
FIG. 13*b*: is an enlarged, partial longitudinal cross section of the device, 13*a*, illustrating one configuration of electro magnetic coil means for energizing the magneto rheological fluid so as to achieve a variable and progressive damping effect.
Figure 13C:
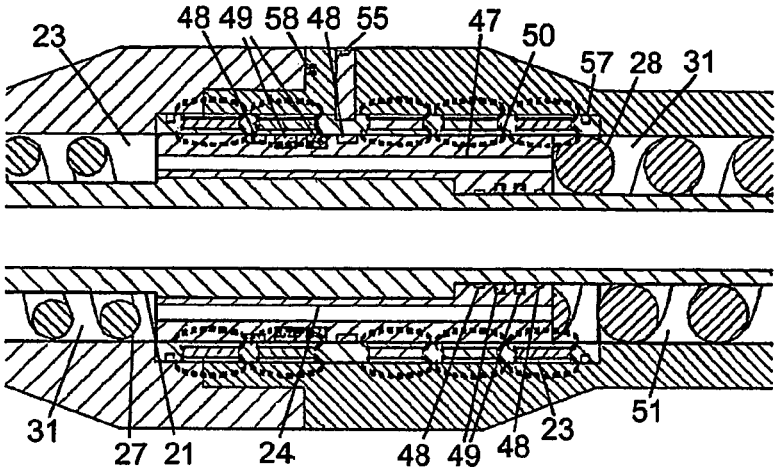
FIG. 13*c*: is a schematic illustrating the relative position of electro-magnetically induced magnetic fields.
Figure 13D:
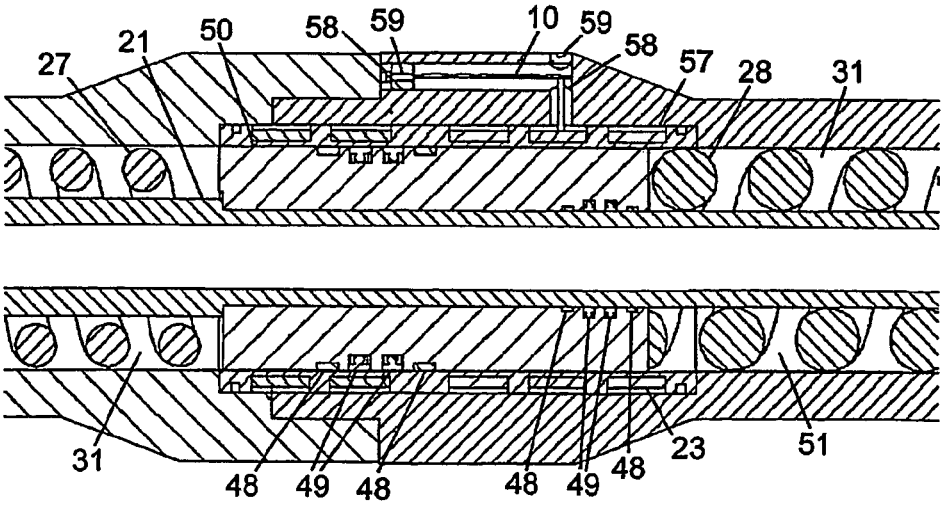
FIG. 13*d*: is a schematic comparable with FIG. 13*b*, but rotated about the z axis to preferentially show instrumentation and wiring loom means.
Figure 13E:
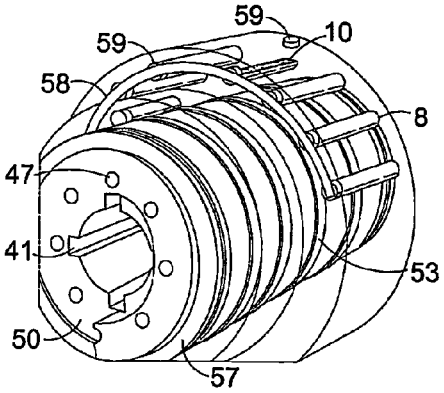
FIG. 13*e*: is a partially cut away, annotated rendering of the sleeve device of FIG. 6 sleeve sub-assembly illustrating potential positions for the downhole power cell means, wiring looms and associated electro-magnetic coil sub assemblies.
Figure 13F:
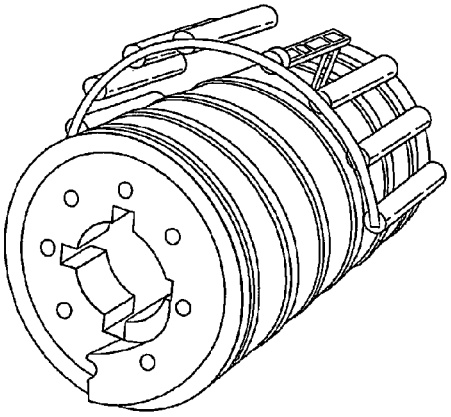
FIG. 13*f*: is a distal three-dimensional rendering of the device illustrating PCB position, cells, wiring looms and electro-magnetic coil sub assemblies.
Figure 13G:
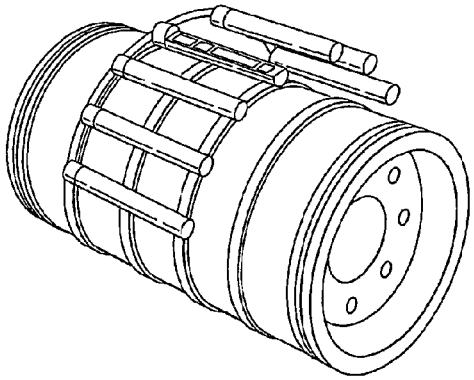
FIG. 13*g*: is a proximal three-dimensional rendering of the device illustrating PCB position, cells, wiring looms and electro-magnetic coil sub assemblies.
Figure 13H:
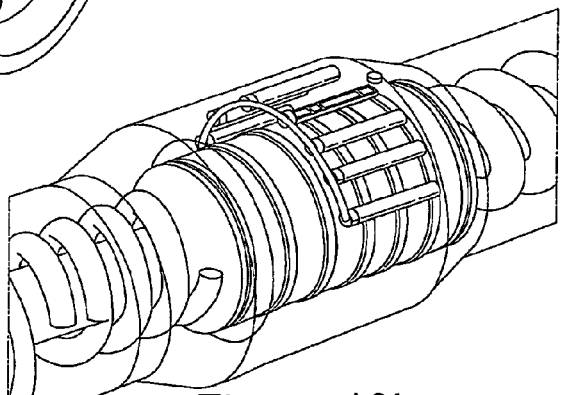
FIG. 13*h*: is a semi-transparent rendering of the sleeve sub-assembly in situ within the housing means.

FIGS. 13*a* and 13*b* illustrate a means of advantageously creating incremental hydraulic damping means between proximal chamber [31] and distal chamber [23] through the use of electro-magnetic coil assemblies [53]. The configuration of the device illustrated herein is equipped with electronic control means [10], incorporating sensor means as required and well understood in the art.

The PCB control means [10] may have integrated sensors, clock timing means, memory, logic means, capacitance capability or such other control sub-systems as are deemed necessary, without departing from the spirit of the instant device.

As with the prior, rare-earth magnet configuration of the invention, the EM coils are located within a sleeve sub-assembly [57], equipped with a key which locks the said assembly to the housing [22].

Power for the device is, preferentially achieved by means of high capacity, high temperature lithium cells which are well understood in the industry. These cells are encapsulated in pressure vessels, which are herein depicted as being integral to the housing [22] sub assembly. These pressure housings are closed with threaded sealing caps [59] and equipped with appropriate static sealing means {not illustrated}.

Alternatively, the power for the instant invention may be provided by turbine alternator mechanisms {not illustrated} which are also prevalent in downhole usage.

Wiring loom means [58] are used as necessary to convey logic, power and control means throughout the housing. The complexity of the wiring loom will be dependent, in part on the number and size of the electro-magnet coils [53] deployed therein.

Initial State of the Device

Tripping State

When tripping in hole, the initial axial position of the mandrel [21] and housing [22], is maintained by forces derived from pre-loaded springs [27], [28], which are located in the upper annular chamber [31], between mandrel and housing. The springs are constrained by the collar [29] which is integral to the mandrel [21] and are placed in compression by the weight of the BHA [2] which is suspended from the distal end of the instant device [20].

The axial cushioning of the lower BHA [2] from the torsionally rigid drill-collar elements [7] of the drilling assembly may also be considered advantageous when tripping into open holes which are ledged, or in interbedded rock formations which often produce alterations in hole diameter.

Drilling State of the First Embodiment

Once the drillbit [1] is placed on the bottom of the hole, fluid flow to the bit is started, drilling commences and further compression is applied to the proximal spring assembly [28].

The device [20] remains, essentially in a neutral state until the amount of weight applied to the bit causes the distal spring assembly [27] and the proximal spring [28] to adjust the degree of compression in response to the positioning of the mandrel [21] and housing [22] with respect to each other.

Overfeed of the drillstring [4] results in often unwanted additional weight or axial load on the drill bit [1] causing the drillstring to reach stalling point. The independent translation of the mandrel [21] and housing [22] with respect to each other and with the sleeve assembly [25] providing the compensating mechanism allows for a reduction in length of the drilling assembly in response to a stall event.

Therefore, as the housing [22] moves relative to the mandrel [21], the sleeve mechanism [25] translates the upward motion of the distal component of the instant device into an anti-clockwise motion relative to the surface torque input means, thus providing relief from the over application of both axial and torque onto the drill bit [1] from the drillstring. Additionally, the helical form of the outer circumferential element [37] of the sleeve [25] being engaged with keys [36] located in the housing member [22] provides for marginal disengagement of the distal elements of the BHA from the bottom of the hole.

Inventive Element of the First Embodiment

If the mandrel [21] and housing [22] elements were equipped with an interstitial sleeve element [25] with splines on inner and outer circumferential surfaces [39], [40], and the assembly was placed under compression, fretting of the splines [24] would be likely to occur, with oscillation of the spring assemblies providing repeat restoring force with inappropriate and fixed damping capability. The torsion component of the sleeve assembly [25], helically formed on the outer circumferential surface [40], provides for non-oscillatory damping capability within the instant device which thus constitutes an inventive step. Additionally, the presence of axial bidirectional restoring forces prevents cyclical wear patterning from occurring; the device remains practically inactive until such time as the pre-determined weight-on-bit limits have been exceeded.

It will be apparent to those skilled in the art, that the instant device is constructed with resistive spring elements [27], [28], which have an inherent natural frequency.

As previously examined, prior art reveals the absence of a damping device which is constructed with a unique natural frequency yet is capable of providing effective damping means across an entire range of operational regimes.

Accordingly, this embodiment of the instant invention seeks improvement over prior art through the incorporation of an adaptive damping element which may be adjusted to provide active damping means across multiple harmonic frequencies and amplitudes which are likely to be encountered in the downhole environment.

Simply expressed, the improvement takes the form of modifications to the sleeve assembly [25] described earlier in the specification. A second, more complex, and related improvement may require the addition of a power source, [8] instrumentation [10] and sensors in order to provide greater versatility of operation across a wider range of harmonic frequencies and amplitudes.

Therefore, supplementing the purely mechanical spring damping means previously described, the instant device may additionally employ magneto-rheological damping means. Additionally the instant device may preferentially employ electro-magnetic actuation means as a method of optimizing damping across a wider operating environment. All of these embodiments are considered within the scope of the instant device and may be considered for deployment into different operational and economic environments of the drilling process.

Re-Cap on MRF in Prior Art

As previously described the use of magneto-rheological fluids in downhole devices is not unknown.

Simplified MRF Synopsis

The instant invention seeks to improve on prior art through the adoption of a simplified schema. Magneto-rheological fluids ("MRF"), as was seen earlier, may have their fluid properties adjusted through exposure to magnetic fields. Preferentially, prior art has utilized electro-magnetic fields in order to alter the viscous properties of the MRF. Prior art in this field has incorporated power generation modules and relatively sophisticated control mechanisms.

The configuration of the instant device lends itself to improvements over prior art. Two simplified methods of managing adjustable damping properties will now be described.

SECOND EMBODIMENT OF THE INVENTION

In both these methods, the modified sleeve assembly [50] is constructed from non-magnetic or magnetically transparent material and is equipped with seals [48], [49], which hermetically seal the volumes between the upper, proximal, chamber [31] and lower, distal, chamber [23]. In this configuration the sleeve acts as a toroidally configured piston means equipped with fluid bypass means [47]. The emplacement and distribution of seals along the length of the tool can be used to form different arrays and arrangements of interconnected fluid chambers for the purpose of controlling fluid movement and transfer across two or more relevant chambers. In this instance the combination of seals at the extremities of each of the chambers combine to form a proximate reservoir chamber [31] and a distal reservoir chamber [23] containing magneto-rheological fluid [51] therein. The reservoir chambers are connected by fluid choke ports [47] which are preferentially contained within the piston sleeve means [50] and which act to restrict the flow of fluids [51] between upper [31] and lower chambers [23]. It will be evident that the number, diameter, form, displacement from the principal axis of the device [20] and format of the pistons [25], [50] and choke ports [47] may be modified without departing from the spirit of the device.

In an alternative configuration the seals radially configured about the sleeve means and which are used to divide the chamber into two separately sealed reservoirs and the fluid communication ports may be dispensed with and the annular space between sleeve element [25] and housing [22] toleranced so as to act, in conjunction with magnetic or electro-magnetic actuation means, as a choke means for controlling the flow of MR Fluids [51] between distal and proximal chambers. This configuration may be preferred in smaller diameter tool sizes.

When, concurrent with a harmonic vibration event, the mandrel [21] and MR equipped sleeve sub-assemblies [50], begin to move proximally in relation to the housing sub-assembly [22], the mandrel [21] rotates counter clockwise relative to the normal motion of the drillstring and translates axially in relation to the housing [22]. This relative motion is unique to the instant device and is advantageously utilized to provide variable frequency damping.

Rare earth magnets [52] are embedded within the inner wall of the housing [18] so as to exert an increasing magnetic field over the fluid choke ports [47] and thus over the rheology of the magneto-rheological fluids contained therein. The damping effect is proportional to the apparent plastic viscosity of the MR fluid [51] which is travelling through the choke ports [47] and which is proportional to the stroke of the piston [50] relative to the housing. Thus, a relatively short displacement of the sleeve piston means [50] will result in minimal additional damping effect arising from the MR fluid [51] transfer. A longer displacement stroke will expose a greater volume of magnetorheological fluid [51] to magnetic influence, thus proportionately increasing the damping capability of the device [20].

The relative helical rotation of the sleeve element with respect to the mandrel and housing in conjunction with reciprocal motion of the sub assemblies makes possible this configuration. Were the motion purely reciprocating, the MRF equipped assembly could potentially hydraulically lock as a result of the apparent increase in plastic viscosity of the MR fluid. The relative helical rotation configuration in conjunction with compression spring restoring means makes possible the deployment of an un-instrumented, relatively simple device which is capable of providing effective damping across a wide range of frequencies. The resultant progressive and incremental alteration to the inherent natural frequency of the system is perceived as being a novel and inventive step of the instant device.

It will be evident that configuring the device such that alternative locations for and differing quantities, sizes or strengths of rare earth magnets [52] may be employed such that an incremental magnetic field, proportional to the degree of internal axial travel within the tool is exerted over the MR fluids [51], may be utilized without departing from the spirit of the instant invention. Thus, magnets [52] may be preferentially embedded in the sleeve assembly [50] the housing [22] or the mandrel [21] with the intention of incrementally focussing the magnetic field to obtain greater damping capability. The rare-earth magnets [52] may be of the type samarium cobalt 1-5 or similar, with very high inherent magnetic field strength, high resistance to demagnetisation and temperature ratings which are consistent with those encountered within the downhole environment are employed.

THIRD EMBODIMENT OF THE INVENTION

Proportional Damping Strokes

As may be inferred from the description of the previous embodiment, electro magnetic coils [53] may be substituted for rare-earth magnets [52]. Although their installation represents an overall increase in system complexity, the presence of instrumentation controlled electronic systems [10] equipped with clock timing capability allows for more precise application of timed, variable control voltages to the magnetorheological fluids [51] in conjunction with advantageous phase shifting of damping capability. In summary, the EM Coil configuration of the instant device illustrated in FIG. 13 allows greater control over the MR fluid [51] elements of the design.

Substitution of EM coils [53] as means for controlling the MR Fluid [51] requires the addition of control instrumentation [10]. The instrumented device may be preferentially equipped with sensors [not illustrated] which provide measurements of shock, acceleration and frequency of downhole vibration. Additional sensor measurements may be made as necessary. Continuous measurement of the vibration inherent in a specific drilling environment allows for iterative adjustment of the electro-magnetic field in order to optimize damping. For this reason, this configuration of the device may be utilized in areas where the natural frequency of harmonic vibration created by the drilling process is relatively high.

It may be envisaged that, equipped with instrumentation, [10] the instant device could be preferentially and advantageously deployed in areas where there is relatively little background information on drilling harmonics, or, alternatively for use in environments where extreme vibration loads are anticipated. Thus deployed, the device provides calibration which may enable subsequent deployment of an un-instrumented construction of the instant invention.

The variable damping capability of the instant device, imparted by the helical motion of the sleeve sub-assemblies [25], [50], coupled with intermittent and comparatively low electrical power requirement is claimed as an advantage over prior art. Thus, the electrical power in the instant invention may be provided by downhole cells [8]. As will be understood by those skilled in the art, the cells [8] may be enclosed within pressure vessels located in the internal diameter of the mandrel sub-assembly arranged in sealed annular cavities located in the housing sub-assembly [22] (as illustrated in FIG. 13) or other convenient locations within the drilling assembly as required.

Sensor Equipped Version

Measurements of shock and acceleration may be taken by sensors located within the lower mandrel. These measurements which are indicative of vibration may be qualitative or quantitative, raw or calibrated, as appropriate.

In the first instance the sensor data is gathered for application within the internal logic of the instant device; in a second embodiment, the sensor data may be gathered for telemetry back to the surface of the earth using any one of a number of well understood methods.

In yet another embodiment, a second, equivalent set of sensors in the upper mandrel sub assembly gather comparative measurements. These measurements are indicative of the efficiency of the active damping device and allow iterative improvements to be made during the drilling process.

Sensor measurements are taken and analyzed to determine the input vibrational characteristics and, through the use of adaptive systems the correct timing and damping energy level with which to achieve optimal damping.

Actuation: Timing and Instrumentation

The inclusion of instrumentation [10] and sensors increases the sophistication of the basic device, allowing greater flexibility of the overall timing of the actuation of the electro-magnetic coil [53] actuations which control the damping characteristics. Additionally, the instrumented device is capable of utilizing the downlink command protocol which was introduced earlier. The downlink protocol, such as that revealed in U.S. Patent Application to McLoughlin & Variava, ADAPTIVE APPARATUS, SYSTEM & METHOD FOR COMMUNICATING WITH A DOWNHOLE DEVICE increases the data which is at the disposal of the downhole instrumentation by allowing the inclusion of sensor measurements or data which have been made at other locations in the downhole or surface environments. Advantageously, the inclusion of data derived from other elements of the drilling assembly enables the instant device to be actively adaptive in actuation. Prior art, not benefiting from external information sources may only claim the benefit of passive and reactive damping capability.

Phase Shift Capability

One advantage which the instrumentation and data downlink capability confers is the ability to phase shift the valve actuation timing. This may result in improved damping capability or the ability to confer preferential levels of damping on specific elements of the drilling assembly resulting in lower levels of vibration at more fragile components of the drilling assembly.

The invention claimed is:

1. A downhole device suitable for connection to a drilling assembly at its distal end, the downhole device comprising:

a mandrel, a housing surrounding said mandrel, a point of torque transfer between the mandrel and the housing, and a compensating mechanism being at the point of torque transfer, the compensating mechanism comprising a sleeve element configured to adjust an axial force applied to said mandrel and sleeve element by changing the relative position of the mandrel and sleeve element with respect to the housing at the point of torque transfer and through interaction of a primary damping means upon the sleeve element subjected to compression by at least one pre-loaded compression spring at the point of torque transfer, and wherein said compensating mechanism further comprises a secondary damping means which is variable in situ to alter the natural frequencies of the device in order to responsively damp oscillatory motion over one or both of a range of input frequencies and amplitudes and which comprises fluid displacement means.

2. A device according to claim 1, wherein said compensating mechanism is configured to adjust the axial force applied to said mandrel when said mandrel rotates with respect to said housing.

3. A device according to claim 1, wherein said compensating mechanism decouples and adjusts simultaneously for axial and torsional compliance in response to varying dynamic and inertial forces generated by the drilling process.

4. A device according to claim 1, wherein the pre-loaded compression spring provides concurrent axial and torsional pre-load within said housing, said compensation mechanism being configured such that when said pre-loaded compression spring is overcome said sleeve element is rotated and axial translation occurs with respect to the mandrel and housing.

5. A device according to claim 4, wherein the sleeve rotational translation has in excess of 90° freedom of motion.

6. A device according to claim 4, the compensating mechanism being adapted such that downhole device can be calibrated or accommodated to the specific drilling conditions by varying its emplacement along the drilling assembly or drillstring.

7. A device according to claim 1, further comprising sensors and instrumentation configured to iteratively, adaptively or otherwise intelligently control the damping of the device.

8. A device according to claim 7, wherein said sensors and instrumentation are further adapted to allow for inclusion and integration of both proximally and distally mounted external sensor information which information may be input via downlink communications, hardwire, electro-magnetic telemetry or other means for the purposes of identifying and informing on state changes in drillstring harmonic frequencies and amplitudes.

9. A device according to claim 1, wherein the compensating mechanism comprises active hydraulic damping using magneto-rheological fluid, said active hydraulic damping being adapted to provide axial and torsional compliance.

10. A device according to claim 9, wherein the active hydraulic damping comprises a first and a second reservoir containing hydraulic fluid control of damping by controlling the transfer of fluids between these two reservoirs.

11. A device according to claim 10, wherein the active hydraulic damping comprises a plurality of fluid transfer conduits and said fluid transfer is affected through said conduits.

12. A device according to claim 9, further comprising rare earth magnets, configured to alter properties of the magneto-rheological fluid.

13. A device according to claim 9, further comprising electro-magnetic coil assembly means configured to alter properties of the magneto-rheological fluid.

14. A method of compensating for unwanted local variations in the drilling process comprising:

providing a mandrel suitable for connection to a section of a drilling assembly, providing a housing, surrounding said mandrel and suitable for connection to a further section of the drilling assembly, providing a point of torque transfer between the mandrel and housing, providing a compensating mechanism comprising a sleeve element at the point of torque transfer, providing a primary damping means acting upon the sleeve element at the point of torque transfer through subjecting the sleeve element to compression by at least one pre-loaded compression spring;

adjusting an axial force applied to said mandrel by changing the relative position of the mandrel with respect to the housing through the sleeve element at the point of torque transfer, wherein the axial force is adjusted by rotating the mandrel with respect to the housing further configured to damp vibrations by controlling hydraulic fluid flow within channels by means of simultaneous axial and rotational translation of an element of the device, and whereby the hydraulic fluid characteristics are altered through variable application of a magnetic field.

* * * * *